United States Patent [19]

Burnett

[11] Patent Number: 4,856,713

[45] Date of Patent: Aug. 15, 1989

[54] DUAL-FUEL INJECTOR

[75] Inventor: Lauren W. Burnett, Blue Springs, Mo.

[73] Assignee: Energy Conservation Innovations, Inc., Oak Grove, Mo.

[21] Appl. No.: 228,326

[22] Filed: Aug. 4, 1988

[51] Int. Cl.[4] ..... B05B 1/30; F02M 61/06

[52] U.S. Cl. ..... 239/113; 239/124; 239/409; 239/410; 239/415; 239/533.2; 239/585; 123/23; 123/300

[58] Field of Search ..... 239/585, 533.2, 407–410, 239/412, 413, 415, 416.2, 417.5, 424, 113, 124; 137/606; 123/23, 299, 300, 446

[56] References Cited

U.S. PATENT DOCUMENTS

| | | | |
|---|---|---|---|
| 4,544,096 | 10/1985 | Burnett | 239/92 |
| 4,708,116 | 11/1987 | Gaa et al. | 123/300 |
| 4,736,712 | 4/1988 | Savkar et al. | 123/23 |
| 4,796,577 | 1/1989 | Baranescu | 123/300 |

*Primary Examiner*—Andres Kashnikow
*Assistant Examiner*—Karen B. Merritt
*Attorney, Agent, or Firm*—Hovey, Williams, Timmons & Collins

[57] ABSTRACT

A dual-fuel injector is provided which allows precisely controlled injection of liquid and slurry fuels into an engine or the like, which prevents separation of solid material from the liquid carrier in the slurry fuel, and which prevents abrasion of selected surfaces of the injector by the solid material. The preferred injector includes a housing and an electronically actuated liquid and slurry fuel assemblies. In operation, pressurized liquid fuel supplied to the injector is used to amplify the injection pressure of the respective fuels for discharge through respective nozzles. The slurry fuel is continously circulated through the injector to prevent separation of the solid material from the liquid carrier and liquid fuel is used to purge selected surfaces of the injector to prevent the abrasion thereof by the solid material in the slurry fuel.

13 Claims, 4 Drawing Sheets

152
92
160
150
154
158
162
164
166
156
170
126
168
174
172
16
20
72
136
24
38
26
62
143
66
148
149
64
130
28
80
146
60
58
56
88
36
54
52
82
68
86
10
48
46
44
34
22
50
74
70
142
122
116
118
14
120
18
112
96
114
108
12
123
106
104
42
102
98
99
90
100
21
94
178
110
176
120
132
128
30
124
140
138
134
40
84

DUAL-FUEL INJECTOR

BACKGROUND OF THE INVENTION

1. Field of the Invention

The present invention relates to a dual-fuel injector which allows precise control of liquid and slurry fuel injection into an engine or the like. More particularly, the present invention relates to an electronically actuated injector which uses pressurized liquid fuel to operate respective liquid and slurry fuel assemblies, which prevents separation of solid material from the liquid carrier in the slurry fuel, and which prevents abrasion of injector surfaces by the solid material.

2. Description of the Prior Art

It is known in the prior art that a pulverized solid fuel material slurried in a liquid carrier can be made to combust in an engine such as a diesel engine. For example, coal slurried in a water carrier can be made to combust in a diesel engine to provide operating power thereto. A typical slurry fuel, however, will not ignite under pressure alone but requires ignition by another source such as conventional diesel fuel.

The technical problems concerning slurry fuel injection have heretofore prevented development of a practical injection system. For example, the ignition timing of a liquid fuel in relation to the timing of slurry fuel injection is critical in order for the solid fuel material to ignite and efficiently burn.

Additionally, the slurry fuel itself presents problems. For example, a solid fuel material such as coal has a tendency to separate from the liquid carrier. When this occurs, the solid material tends to accumulate within the injector rendering it inoperable. Also, a solid material such as coal tends to accumulate adjacent moving surfaces in an injector and quickly abrades and corrodes these surfaces.

Furthermore, known prior art fuel injection systems for liquid and slurry fuels use separate injectors which increase the mechanical complexity of the system, and use mechanically operated slurry fuel injectors which require coupling with the cam shaft of the engine. This prevents effective "on-the-go" adjustment of the injection timing at different engine operating speeds.

SUMMARY OF THE INVENTION

The problems as outlined above are solved by the dual-fuel injector of the present invention. More particularly, the dual-fuel injector hereof provides for a mechanically simple and reliable unitary injector for injecting both liquid and slurry fuels, allows precise control of injection timing and fuel quantity, prevents separation of the solid material from the liquid carrier within the injector, and prevents abrasion of selected injection surfaces by the solid material.

Broadly speaking, the preferred dual-fuel injector includes a housing and respective liquid and slurry fuel assemblies. The assemblies and housing walls define respective liquid and slurry fuel discharge nozzles.

The liquid fuel assembly includes a selectively actuatable liquid fuel injector operably received within the housing for selectively discharging liquid fuel through the liquid fuel nozzle, and liquid fuel actuator for selectively actuating the liquid fuel injector. The slurry fuel assembly preferably includes a selectively actuatable slurry fuel injector operably received within the housing for selectively discharging slurry fuel through the slurry fuel nozzle, and slurry fuel actuator for selectively actuating the slurry fuel injector means.

In preferred forms the injector includes a slurry fuel injection chamber communicating with a slurry fuel inlet and outlet such that slurry fuel continuously circulates through the injector in order to prevent separation of the solid material from the liquid carrier. The preferred injector also includes a purging mechanism for directing a flow of liquid fuel between selected surfaces of the injector to prevent accumulation of solid fuel material therebetween in order to prevent abrasion of these surfaces.

In particularly preferred forms the slurry fuel assembly includes a slurry fuel pump piston having response to the application of pressurized liquid fuel thereto for discharging slurry fuel through the slurry fuel nozzle. More particularly, the slurry fuel injector is configured to pressurize the slurry fuel to a pressure greater than the liquid fuel pressure.

The preferred slurry fuel assembly also includes a slurry fuel nozzle valve which is responsive to a predetermined amount of pressure of the slurry fuel to open the slurry fuel nozzle and allow discharge of slurry fuel therethrough. The preferred slurry fuel actuator is responsive to the application of electronic signals thereto for actuating the slurry fuel injector.

Other preferred aspects of the present invention are explained further hereinbelow.

BRIEF DESCRIPTION OF THE DRAWING FIGURES

DETAILED DESCRIPTION OF THE PREFERRED EMBODIMENT

A. Dual-Fuel Injector Structure

Figure 1:
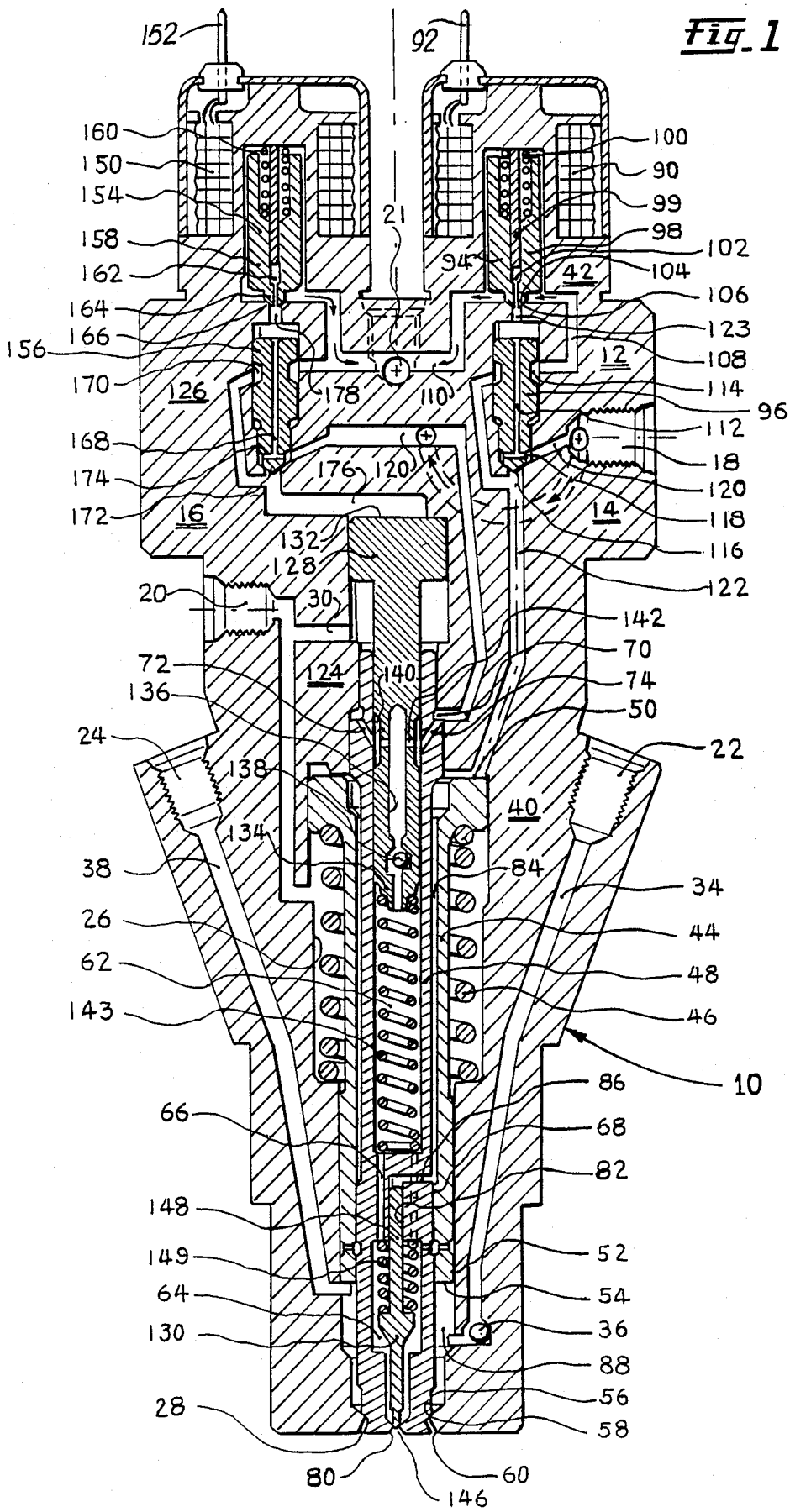
FIG. 1 is a side-sectional view of the preferred dual-fuel injector.

Referring now to the FIGS. 1–4, dual-fuel injector 10 broadly includes housing 12, slurry fuel assembly 14, and liquid fuel assembly 16.

Housing 12 includes liquid fuel inlet 18, liquid fuel outlet 20 and 21, slurry fuel inlet 22, and slurry fuel outlet 24. Housing 12 also includes structure defining central bore 26 and discharge opening 28 communicating bore 26 with the exterior of injector 10 as shown.

Central bore 26 also communicates with liquid fuel outlet 20 via outlet passages 30 and 32 and with slurry fuel inlet 22 by way of slurry fuel inlet passage 34 having ball check 36 therein to prevent reverse flow through passage 34. Additionally, central bore 26 communicates with slurry fuel outlet 24 by way of slurry fuel outlet passage 38. Housing 12 includes other ports and passages which are identified and enumerated hereinbelow.

Slurry fuel assembly 14 broadly includes slurry fuel injector 40 and slurry fuel actuator 42. Slurry fuel injector 40 includes slurry fuel piston pump 44, piston pump spring 46, and slurry fuel valve structure 48.

Elongated tubular slurry fuel piston pump 44 is axially and shiftably received within central bore 26. Piston pump 44 presents upper piston surface 50 and tip portion 52 presenting lower piston surface 54 (see also FIGS. 2 and 4). Upper piston portion 50 presents a net effective surface area approximately four times as great as the effective surface area of lower piston surface 54 in order to amplify by a factor of four the pressure applied to the slurry fuel as explained further hereinbelow. Pump piston spring 46 biases piston pump 44 upwardly as shown.

Elongated slurry fuel valve structure 48 is axially and shiftably received within piston pump 44 as shown and presents valve surface 56 which is configured to mate with corresponding valve seat surface 58 of housing 12. Valve surface 56 and valve seat surface 58 cooperatively define slurry fuel discharge nozzle 60 which is shown in its quiescent and closed position in FIGS. 1 and 2.

Figure 3:
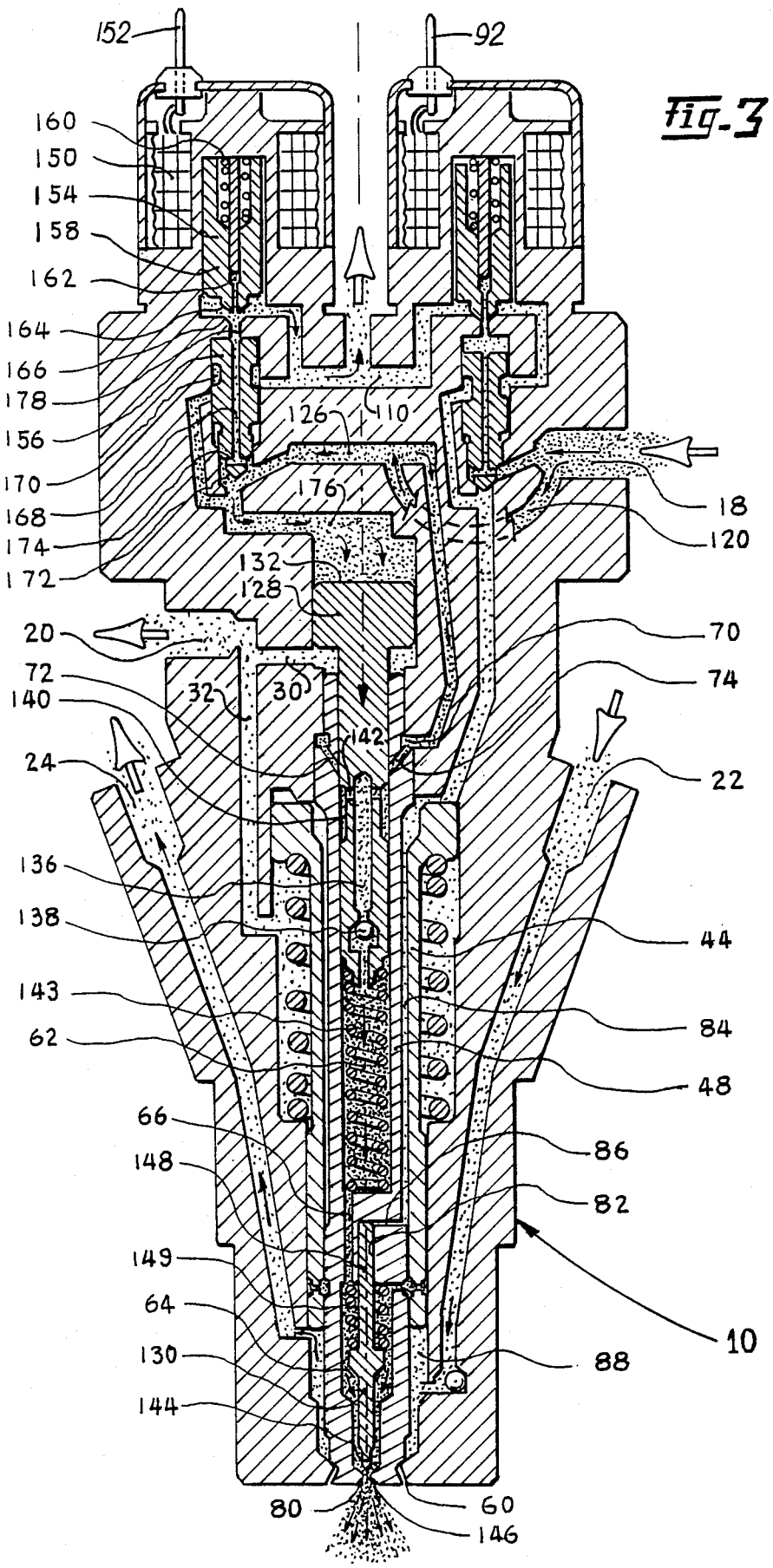
FIG. 3 is a side-sectional view of the injector illustrating operation thereof during liquid fuel discharge.
Figure 4:
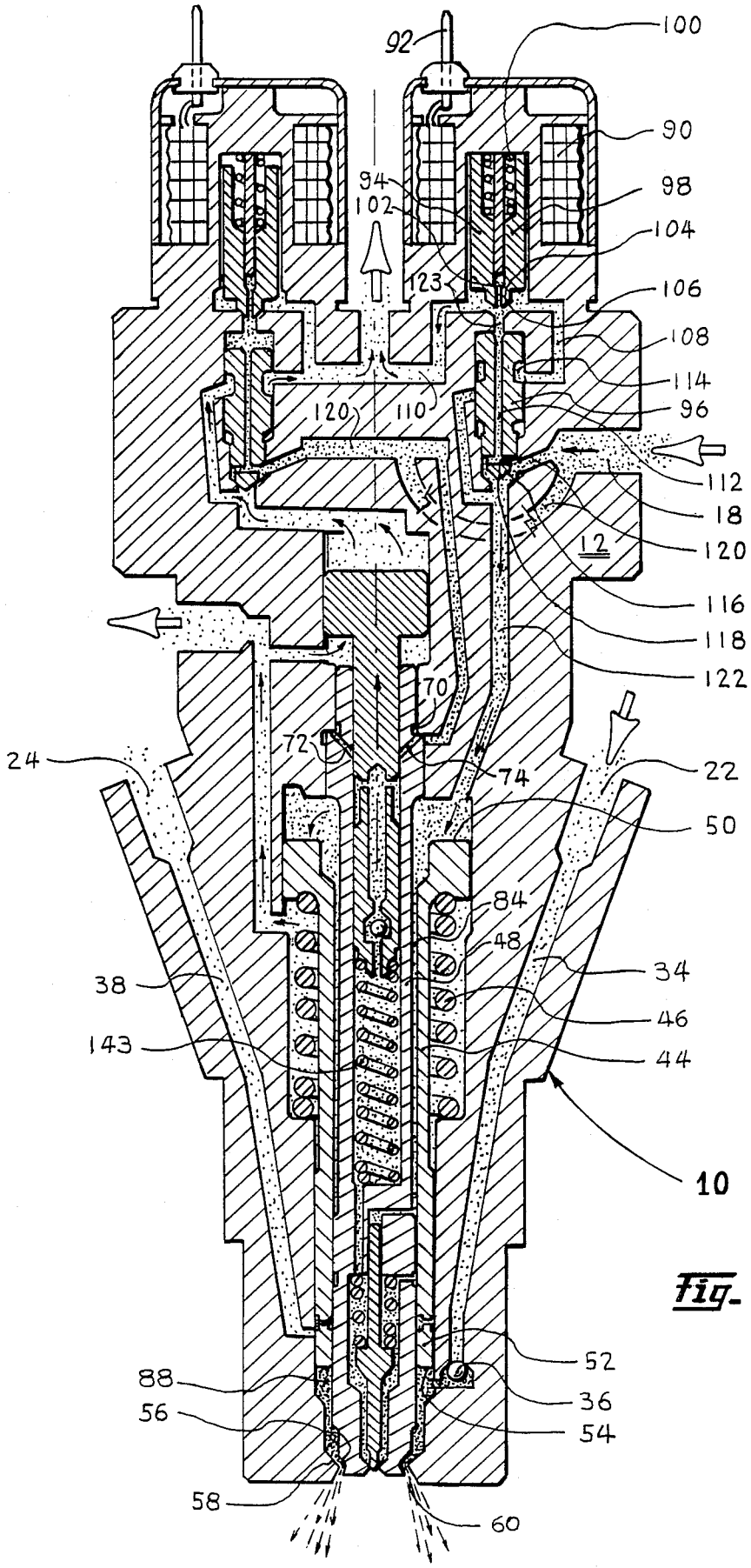
FIG. 4 is a side-sectional view of the injector illustrating operation thereof during slurry fuel discharge.

The interior of valve structure 48 presents elongated reception chamber 62 which is open at the upper end thereof for receiving portions of liquid fuel assembly 16 therein, and presents liquid fuel injection chamber 64 located below and axially aligned with reception chamber 62 with transfer passages 66 and 68 intercommunicating chambers 62 and 64. Valve structure 48 also includes structure defining annular circumscribing transfer groove 70 interconnected with reception chamber 62 by respective passages 72 and 74 (FIGS. 3 and 4).

Figure 2:
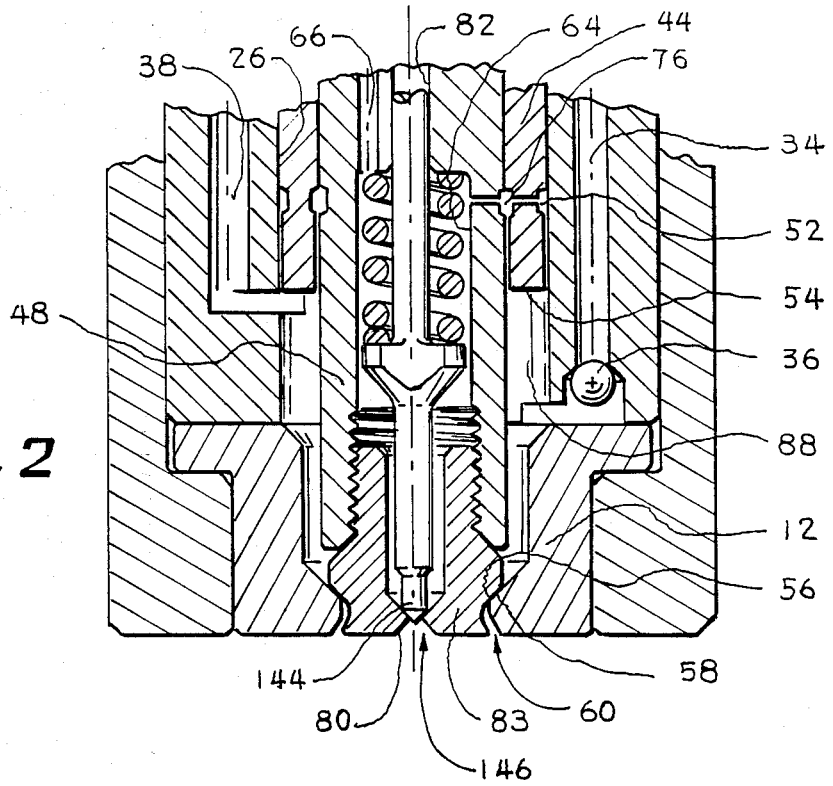
FIG. 2 is an enlarged, partial sectional view of the injector showing details in the vicinity of the liquid and slurry fuel nozzles.
Figure 5:
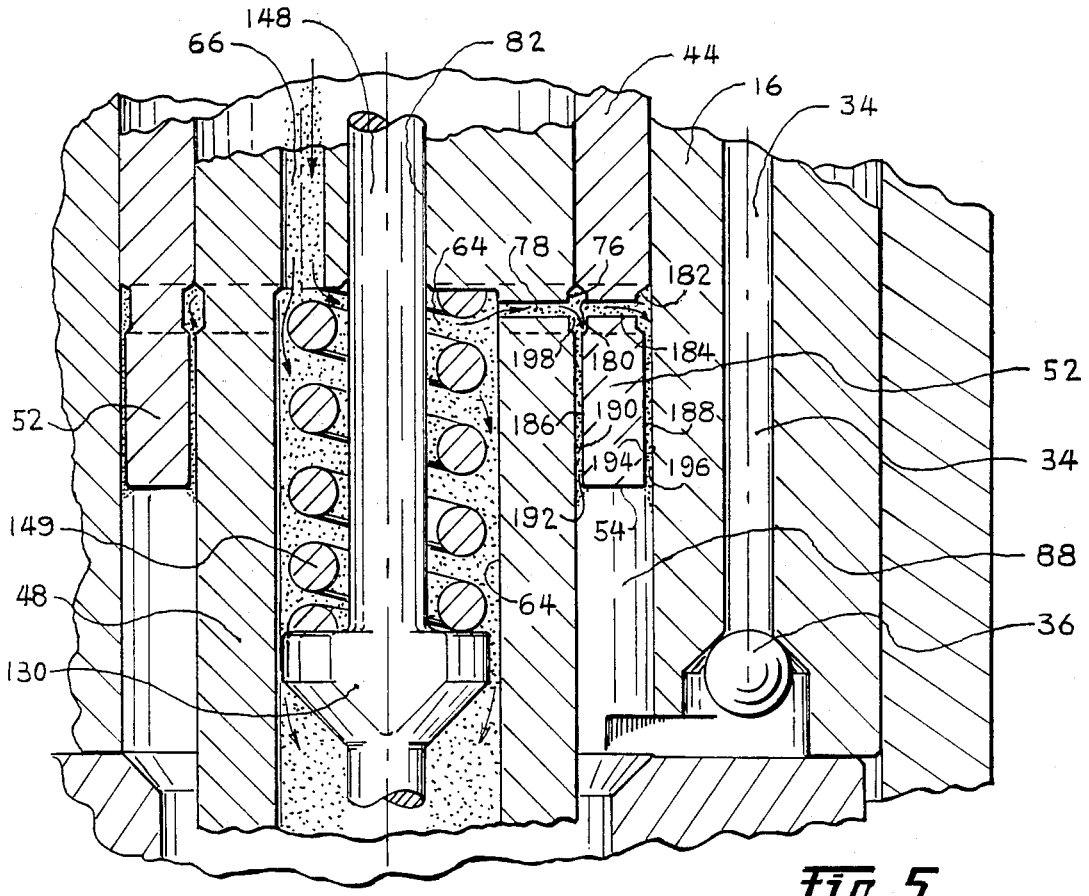
FIG. 5 is an enlarged side-sectional view of the injector showing details of the liquid fuel purge.

Additionally, valve structure 48 includes structure defining annular circumscribing purge groove 76 which communicates with liquid fuel injection chamber 64 by way of purge passage 78 (FIGS. 2 and 5). Valve structure 48 also presents lower end opening 80 and pintle stem guide opening 82.

Slurry fuel nozzle valve structure 48 also includes replaceable tip section 83 (FIG. 2) composed of abrasion resistant ceramic or tungsten carbide steel which is threadably coupled with valve structure 48 to facilitate removal and replacement.

The respective diameters of piston pump 44 and nozzle valve structure 48 are such that space 84 is presented therebetween which is interconnected with pintle stem guide 82 by way of passage 86. Slurry fuel piston pump 44, slurry fuel nozzle valve 48, and the walls of housing 12 cooperatively define slurry fuel injection chamber 88.

Slurry fuel actuator 42 includes electromagnetic coil 90 including connection terminal 92, slurry fuel armature valve 94, and slurry fuel pilot valve 96.

Armature valve 94 includes axially shiftable valve body 98, spring 100 which biases body 98 downwardly and axially disposed equalizing passage 102, and counterbalance pin 99 which neutralizes the pressure bias acting on valve tip 104.

Valve body 98 includes a valve tip 104 designed to mate with corresponding valve seat 106 defined by the walls of housing 12. In this way, armature valve 94 is operable to selectively interconnect intermediate passage 108 and drain passage 110 defined in housing 12. Drain passage 110 is connected to liquid fuel outlet 21 through an internal housing passage 110.

Coil 90 is responsive to the reception of an electrical signal from appropriate conventional control source thereof to magnetically shift valve body 98 upwardly in order to interconnect passages 108 and 110.

Axially shiftable pilot valve 96 includes axially aligned equalizing passage 112, annular circumscribing transfer groove 114, pilot valve tip 116, and transverse passage 118 extending through valve tip 116 and intercommunicated with equalizing passage 112. Pilot valve 96 is interposed between liquid fuel inlet passage 120, liquid fuel transfer passage 122, equalizing port 123, and intermediate passage 108.

Liquid fuel assembly 16 broadly includes liquid fuel injector 124 and liquid fuel actuator 126.

Liquid fuel injector 124 includes liquid fuel piston pump 128 partially received and axially shiftable within reception chamber 62 and liquid fuel pintle 130 received and axially shiftable within liquid fuel injection chamber 64.

Liquid fuel piston pump 128 presents upper piston surface 132 and lower end portion 134. Upper surface 132 presents an effective surface area four times as great as that of lower end portion 134 in order to amplify the liquid fuel pressure within liquid fuel injection chamber 64 to a pressure four times as great as that of the liquid fuel pressure received from the source thereof as will be explained further hereinbelow.

Liquid fuel piston pump 128 also presents an axially aligned central opening 136 which opens and thereby communicates with reception chamber 62 by way of ball check 138 which prevents liquid fuel flow from reception chamber 62 into central opening 136. Piston pump 128 also presents an annular circumscribing transfer groove 140 which in the quiescent state is aligned for communication with passages 72, 74. Groove 140 communicates with central opening 136 by way of transfer passages 142. Spring 143 is axially aligned with and disposed between lower end portion 134 and nozzle valve structure 48 within reception chamber 62 and biases piston pump 128 upwardly and valve structure 48 downwardly with reference to the drawing figures.

Pintle 130 includes lower tip 144 (FIGS. 2 and 3) which mates with a corresponding interior surface of slurry fuel nozzle valve structure 48 to form liquid fuel discharge nozzle 146 and presents upper stem 148 which is shiftably received within piston stem guide opening 82. Spring 149, disposed between the upper wall of chamber 64 and a retaining shelf of pintle 130, biases pintle 130 downwardly which in turn biases nozzle 146 toward the closed position.

Liquid fuel actuator 126 is structurally the same as slurry fuel actuator 42 and includes electromagnetic coil 150 having connection terminal 152, armature valve 154, and pilot valve 156. Armature valve 154 includes valve body 158, biasing spring 160, equalizing passage 162, and valve tip 164 designed to mate with a corresponding valve seat 166 of housing 12.

Pilot valve 156 includes equalizing passage 168, transfer groove 170, pilot valve tip 172, and transverse passage 174. Pilot valve 156 is interposed between liquid fuel passage 120, liquid fuel pump passage 176, liquid fuel drain passage 10, and transfer port 178.

B. Liquid Fuel Injection

Dual-fuel injector 10 is preferably used in the context of a low speed diesel engine such as a railroad locomotive, marine engine, or stationary electric generator using conventional diesel fuel as the liquid fuel and pulverized coal slurried in water as the liquid carrier. In this context, water is preferred as the liquid carrier in order to conserve diesel fuel which is a particular advantage of the present invention. Those skilled in the art will appreciate, however, that the present invention is advantageous where the liquid fuel includes other fuels such as kerosene or methanol and in which the solid material includes other combusitble solids other than coal and may include other liquid carriers which may coincidentally also be a liquid fuel.

In a preferred environment of use, injector 10 is connected to the injection port of a diesel engine cylinder with a similar injector coupled to the other cylinders of the diesel engine. Diesel fuel is preferably supplied to liquid fuel inlet 18 at preferred 3,000 p.s.i. by way of a high pressure pump from a fuel tank and liquid fuel outlet 20 is connected at low pressure by way of a return and drain line to the fuel tank. Terminals 152 and 92 are connected to a conventional electronic controller preferably incorporating microprocessor technology for reception of appropriate control signals in order to control the actuation of liquid fuel assembly 16. In this regard, reference is made to U.S. Pat. No. 4,544,096, the disclosure of which is hereby incorporated by reference.

FIG. 1 illustrates liquid fuel assembly 16 in its quiescent state, that is, when it is not discharging liquid fuel through nozzle 146. In the quiescent state, coil 150 is deenergized and spring 160 biases armature valve body 158 downwardly thereby closing the connection between port 178 and drain 110. Pilot valve 156 is also shifted downwardly so that pilot valve tip 172 closes the connection between liquid fuel inlet passage 120 and pump passage 176. Transfer groove 170 interconnects pump passage 176 with drain passage 110 thereby placing these passages at zero pressure. Transverse passage 174 and equalizing passage 168 interconnect liquid fuel inlet passage 120 at 3,000 p.s.i. with liquid fuel port 178 which in turn transfers liquid fuel at this passage by way of equalizing passage 162 to armature valve 158. This additional pressure holds pilot valve 156 closed. That is to say, the provision of transverse passage 174 and equalizing passage 68 causes the downward bias above pilot valve 168 to substantially exceed the upward bias of fuel passage 120 such that this differential maintains pilot valve 156 in closed position.

Also in the quiescent state, liquid fuel pressure at 3,000 p.s.i. is transferred via liquid fuel inlet passage 120, groove 70, transfer passage 72, 74, and opening 136 through ball check 138 into reception chamber 62 and into fuel injection chamber 64 by way of transfer passages 66 and 68. The diesel fuel pressure within reception chamber 62 along with the bias of spring 143 maintains piston pump 128 in the upwardly shifted position. The diesel fuel pressure within injection chamber 64 at 3,000 p.s.i. is not sufficient to overcome the bias of spring 149 and nozzle 146 thereby remains closed.

Referring now to FIG. 3, when an appropriate electrical signal is received at connector 152, coil 150 is thereby energized and magnetically lifts armature 154 overcoming the bias of spring 160. When armature valve 154 lifts from seat 166, diesel fuel pressure is relieved via port 178 to drain passage 110. With this pressure relieved, pilot valve 156 shifts upwardly due to the pressure of diesel fuel thereunder.

With pilot valve 156 shifted upwardly as shown in FIG. 3, the interconnection between pump passage 176 and drain 110 via groove 170 is closed and diesel fuel at 3,000 p.s.i. is transferred by way of passage 176 to top surface 132. This shifts liquid fuel piston pump 128 downwardly because the surface area presented by surface 132 is four times as large as the effective surface area presented by the surface area of lower portion 134. Thus, as pump piston 128 shifts downwardly, ball check 138 closes, and the fuel pressure within reception chamber 62 and injection chamber 164 is amplified to a level which would approach 12,000 p.s.i. by virtue of the 4-to-1 amplification factor.

The bias of pintle spring 149, however, is designed to allow pintle 130 to shift upwardly when the pressure in injection chamber 64 reaches 8,000 p.s.i. That is to say, as the pressure in injection chamber 64 rises, a pressure differential is created relative to the pressure in stem guide opening 82 above stem 148. When this pressure differential reaches 8,000 p.s.i., diesel pintle 130 shifts upwardly to discharge diesel fuel through liquid fuel discharge nozzle 146. Diesel fuel continues to discharge through nozzle 146 as long as piston pump 128 continues to shift downwardly which is as long as coil 158 remains energized until piston pump 128 reaches the limit of its travel. In this way, the amount of diesel fuel injected is controlled by the time interval during which coil 150 is energized. The injection of diesel fuel at 8,000 p.s.i. causes it to atomize a fine mist approaching a gaseous state which allows rapid combustion.

When coil 150 is deenergized, armature valve 154 closes the connection between port 178 and drain passage 110 which allows pressure to build up rapidly in port 178 which in turns shifts pilot 156 downwardly to close the connection between liquid fuel inlet passage 120 and pump passage 176. This reconnects pump passage 176 to drain passage 110 via groove 170 which relieves the pressure on upper piston surface 132 which then shifts upwardly to its quiescent position by virtue of spring 143. When this occurs, the pressure in chamber 64 is reduced and spring 149 shifts pintle 130 downwardly to close nozzle 146.

In typical operation, the diesel fuel is injected near the top of the compression stroke of the diesel cylinder such that it ignites almost immediately. The timing of the injection can be controlled electronically as desired depending upon the power demands being placed on the engine in order to achieve the maximum efficiency. In normal operation, the amount of diesel fuel injected is small and is designed to be just enough to cause ignition of the slurry fuel to be subsequently injected. That is to say, in normal operation slurry fuel is injected immediately after the diesel fuel is injected such that the diesel fuel is already ignited when the slurry fuel enters the engine cylinder. In this way, the ignited diesel fuel ignites the slurry fuel.

C. Slurry Fuel Injection

FIG. 1 illustrates slurry fuel assembly 14 in the quiescent state when no slurry fuel being discharged through nozzle 60. Slurry fuel inlet 22 is connected to a source of slurry fuel and outlet 24 is connected to a return drain line for returning slurry fuel to the source for recirculation. In the quiescent state, coil 90 is deenergized and armature valve body 98 is shifted downwardly by spring 100. This in turn closes the connection between intermediate passage 108 and drain passage 110. Liquid fuel at 3,000 p.s.i. is transferred from inlet 18 and passage 120 through transverse passage 118 and equalizing passage 112 into port 123. This causes pressure to build up above pilot valve 96 to 3,000 p.s.i. which holds pilot valve 96 closed thereby closing the connection between inlet passage 120 and liquid fuel transfer passage 122. Additionally, transfer passage 122 is connected by way of transfer groove 114 in pilot valve 96 to intermediate passage 108. Slurry piston pump 44 is shifted upwardly by spring 46 and slurry fuel valve structure 48 is shifted downwardly thus closing nozzle 60 by spring 143, and the downward bias exerted at transfer groove 70 due to the diameter differential of fuel valve structure 48 at that location.

In the quiescent state slurry fuel continuously passes through injector 10 by way of inlet 22, inlet passage 34, ball check 36, slurry fuel injection chamber 88, outlet passage 38 and slurry fuel outlet 24. With this provision, slurry fuel continuously moves through injector 10 and returns to its source thereby keeping the pulverized coal in suspension in the water carrier. Without this provision, the solid material would have a tendency to settle in dead spots in injector 10 thereby inhibiting its operation or rendering it completely inoperable.

When coil 90 is energized by way of connector 92, armature valve body 98 shifts upwardly against the bias of spring 100 which in turn opens the connection between port 123 and drain passage 110. This in turn relieves the 3,000 p.s.i. pressure above pilot valve 96 allowing the liquid fuel inlet pressure to shift pilot 96 upwardly. When this occurs, pressurized liquid fuel transfers from passage 120 to passages 122.

Liquid fuel by way of passage 122 is transferred to upper piston surface 50 which shifts pump piston 44 downwardly overcoming the bias of spring 46. When this occurs, tip portion 52 shifts downwardly and past the opening to outlet passage 38 thereby closing this passage. The downward movement also pressurizes the slurry fuel contained within slurry fuel injection chamber 88. Ball check 36 closes and prevents backflow of slurry fuel along passage 34 toward inlet 22. Recalling that the surface area of upper piston surface 50 is four times that of lower piston surface 54, piston pump 44 is operable to create a slurry fuel pressure within chamber 88 up to about 12,000 p.s.i. which is four times that of the liquid fuel pressure at 3,000 p.s.i. exerted on upper piston surface 50. The configuration of slurry fuel nozzle valve 48, however, is such that when the slurry fuel pressure within chamber 88 reaches about 8,000 p.s.i., the bias of spring 143 plus the downward bias exerted at transfer groove 70, is overcome and valve structure 48 shifts upwardly thereby opening nozzle 60. Nozzle 60 remains open as long as piston pump 44 pressurizes the slurry fuel within chamber 88 to at least 8,000 p.s.i.

As can be seen in the drawing figures, nozzle 60 is configured as a circular opening which efficiently disburses the slurry fuel discharged therethrough so that the pulverized coal is rapidly ignited.

As with liquid fuel assembly 16, slurry fuel assembly 14 continues to discharge slurry fuel through nozzle 60 as long as coil 90 remains energized to the limit of the stroke of piston pump 44. In this way, as with the liquid fuel, the quantity of slurry fuel injected with each operation can be electronically and precisely controlled.

When coil 90 is deenergized, armature 100 shifts valve body 98 downwardly to close off the connection between port 123 and drain passage 110. When this occurs, the pressure above pilot 96 builds to 3,000 p.s.i. and in the process shifts pilot valve 96 downwardly to close the connection between liquid fuel inlet pasage 120 and transfer passage 122. With pilot valve shifted downwardly, the connection is completed between transfer passage 122 and intermediate passage 108 by way of transfer groove 114 to relieve the pressure on upper piston surface 50 which in turns allows spring 46 to shift piston pump 44 upwardly. As soon as the pressure in slurry fuel combustion chamber 88 drops below 8,000 p.s.i., nozzle valve 48 shifts downwardly under the bias of spring 143 plus the downward bias exerted at transfer groove 70, to close nozzle 60.

As piston pump 44 shifts upwardly, communication between injection chamber 88 and outlet passage 38 is reestablished thereby reestablishing circulation of slurry fuel through injector 10. In this way, circulation is maintained whenever slurry fuel is not being discharged through nozzle 60.

FIG. 5 is an enlarged view of the lower portion of injector 10 and illustrates the details of the purging mechanism of the present invention. Tip portion 52 of slurry piston pump 44 includes a pair of corresponding annular circumscribing grooves 180 and 182 defined respectively on the interior and exterior surface sides thereof as shown in FIG. 5. Grooves 180, 182 are aligned with one another and with groove 76 when piston pump 44 is in the quiescent condition. Tip portion 52 also includes a purge passage 184 (as shown in FIG. 5) intercommunicating grooves 180, 182. Grooves 180, 182 are spaced from surface 54 by corresponding parallel tip surfaces 186 and 188. Valve structure 48 presents surface 190 parallel to surface 186 defining space 192 therebetween. Similarly, cylinder 16 presents surface 194 parallel to tip surface 188 with space 196 therebetween.

As those skilled in the art will appreciate, solid fuel material and in particular, pulverized coal can be very abrasive and corrosive. During operation of injector 10, the presence of solid fuel material in the spaces 192, 196 could cause abrasion and corrosion of surfaces 186, 188, 190, and 194 as piston pump 44 shifts downwardly. To avoid this problem, liquid fuel as a purging fluid continuously flows from liquid fuel injection chamber 64, through purge transfer passage 78 (which is of minute area) into space 198 defined between the surfaces defining grooves 76 and 180. Space 198 in effect acts as a header to distribute purging fluid therealong for passage into space 192 and also by way of purge transfer passages 184 into space 196. Recalling that liquid fuel injection chamber 64 is continuously supplied with liquid fuel at 3,000 p.s.i. during the quiescent state, liquid fuel is thereby supplied continuously to purge spaces 192, 196. This prevents solid material from entering spaces 192, 196 and abrading the adjacent surfaces when piston pump 44 again begins its downward stroke. Also recalling that pressure in injector chamber 64, just prior to the slurry injection pulse, has peaked to 12,000 p.s.i. and has created a high pressure wave through transfer passage 78 and transfer passages 184 then downward about the inner and outer surfaces of tip portion 52. As the slurry injection cycle starts, the slurry pump piston 44 moves rapidly downward overlapping annular groove 76 (see FIG. 4) and preventing any possible reverse (back) flow to chamber 64 due to decay of pressure in chamber 64 and increase of pressure in chamber 88.

As those skilled in the art will appreciate, the present invention encompasses many variations in the preferred embodiment herein described. As discussed above, the injector hereof is useful for injecting a wide variety of liquid fuels such as methanol mixtures, kerosene, fuel oil, and so forth. Additionally, the liquid carrier can also be liquid fuels if desired rather water herein preferred and the solid material slurried therein can include other solids which can be pulverized for suspension in the liquid carrier.

Having thus decribed the preferred embodiment of the invention, the following is claimed as new and desired to be secured by Letters Patent:

1. A dual-fuel injector for injecting a liquid fuel and a slurry fuel into a combustion chamber or the like, the slurry fuel including a solid material suspended in a liquid carrier, the dual-fuel injector comprising:

a housing having structure defining respective liquid and slurry fuel inlets for receiving liquid and slurry fuels from respective sources thereof, and having housing walls defining a discharge opening;

a liquid fuel assembly;

a slurry fuel assembly, said assemblies and housing walls defining respective liquid and slurry fuel discharge nozzles, said liquid fuel assembly including selectively actuatable liquid fuel injection means operably received within said housing for selectively discharging liquid fuel received from said liquid fuel inlet through said liquid fuel nozzle, and liquid fuel actuator means for selectively actuating said liquid fuel injection means, said slurry fuel assembly including selectively actuatable slurry fuel injection means operably received within said housing for selectively discharging slurry fuel received from said slurry fuel inlet through said slurry fuel nozzle, and slurry fuel actuator means for selectively actuating said slurry fuel injection means.

2. The injector as set forth in claim 1, further including means defining a slurry fuel outlet in said housing for exit of slurry fuel therefrom, and means defining a slurry fuel chamber within said housing communicated with said slurry fuel inlet and outlet for allowing movement of slurry fuel through said slurry fuel inlet, injection chamber, and outlet in order to prevent separation of the solid material from the liquid carrier in said injector.

3. The injector as set forth in claim 1, said housing and assemblies presenting certain adjacent surfaces shiftable relative to one another, said injector including means for directing a flow of liquid fuel between selected ones of said adjacent surfaces in order to prevent the presence of solid material therebetween thereby preventing abrasion of said adjacent surfaces by the solid material.

4. The injector as set forth in claim 1, said liquid fuel inlet receiving pressurized liquid fuel from a source thereof, said slurry fuel injection means including means responsive to the application of pressurized liquid fuel thereto for actuation thereby in order to discharge slurry fuel through said slurry fuel nozzle, said slurry fuel actuator means including a slurry piston pump and means for selectively applying pressurized liquid fuel thereto for actuation thereof.

5. The injector as set forth in claim 4, further including means defining a slurry fuel injection chamber within said housing interposed between said pump piston and said slurry fuel nozzle and communicated with said slurry fuel inlet for receiving slurry fuel therefrom, said piston pump including means for engaging and pressurizing slurry fuel contained within said slurry fuel injection chamber in response to application of pressurized liquid fuel to said pump piston.

6. The injector as set forth in claim 5, said pump piston pressurizing said slurry fuel to a pressure greater than the pressure of said pressurized liquid fuel applied to said pump piston.

7. The injector as set forth in claim 5, said slurry fuel assembly including means for selectively closing and opening said slurry fuel nozzle and for opening said slurry fuel nozzle in response to a predetermined pressure of slurry fuel within said slurry fuel chamber.

8. The injector as set forth in claim 1, the slurry fuel including pulverized coal suspended in water.

9. The injector as set forth in claim 1, liquid fuel including diesel fuel.

10. The injector as set forth in claim 1, said assemblies being axially aligned.

11. The injector as set forth in claim 10, said liquid fuel assembly having a portion thereof axially received within said slurry fuel assembly.

12. The injector as set forth in claim 1, said liquid and slurry fuel actuator means each including means for receiving electronic signals and for responding thereto for actuating said respective liquid and slurry fuel injection means.

13. The injector as set forth in claim 1, said liquid and slurry fuel injection means being operable for discharging respective amounts of liquid and slurry fuel through said respective nozzles corresponding to the duration of said respective electronic signals.

* * * * *